US010094160B2

(12) United States Patent
DeBaldo

(10) Patent No.: US 10,094,160 B2
(45) Date of Patent: Oct. 9, 2018

(54) TONGUE AND GROOVE MODULAR FIRE SAFE

(71) Applicant: Michael B. DeBaldo, Colorado Springs, CO (US)

(72) Inventor: Michael B. DeBaldo, Colorado Springs, CO (US)

( * ) Notice: Subject to any disclaimer, the term of this patent is extended or adjusted under 35 U.S.C. 154(b) by 289 days.

(21) Appl. No.: 15/073,015

(22) Filed: Mar. 17, 2016

(65) Prior Publication Data

US 2016/0273259 A1 Sep. 22, 2016

Related U.S. Application Data

(60) Provisional application No. 62/136,452, filed on Mar. 21, 2015.

(51) Int. Cl.
*E05G 1/024* (2006.01)

(52) U.S. Cl.
CPC ..... *E05G 1/024* (2013.01); *E05Y 2800/205* (2013.01); *E05Y 2800/45* (2013.01)

(58) Field of Classification Search
CPC ..... E05G 1/024; E05Y 2800/205; E05Y 2800/45; E04B 1/942; E04B 1/34321; E04B 1/043; E04C 2/28; E04C 2/292; E04H 1/005; E04F 2201/044; E04F 2201/046
USPC ..... 109/24, 49.5, 51, 58, 78–85; 312/108, 312/257.1, 409; 52/588.1, 592.6, 582.1, 52/586.1; 220/4.26, 4.27, 4.28, 4.31, 220/4.32, 4.33, 4.34, 690, 692, 693, 682
See application file for complete search history.

(56) References Cited

U.S. PATENT DOCUMENTS

| | | | | |
|---|---|---|---|---|
| 20,736 | A | * | 6/1858 | Sharts |
| D146,782 | S | | 1/1874 | Richardson |
| D174,129 | S | | 2/1876 | Fitzgerald |
| 252,435 | A | * | 1/1882 | Damon |
| 370,471 | A | * | 9/1887 | Gross |
| 396,040 | A | * | 1/1889 | Hough |
| 405,562 | A | * | 6/1889 | King |
| 405,655 | A | * | 6/1889 | Baum |
| D450,196 | S | | 4/1891 | See |
| 470,017 | A | * | 3/1892 | Simmons |
| D470,017 | S | | 3/1892 | Simmons |

(Continued)

FOREIGN PATENT DOCUMENTS

CA 2865841 * 3/2015

*Primary Examiner* — Lloyd A Gall
(74) *Attorney, Agent, or Firm* — MacMillan, Sobanski & Todd, LLC

(57) ABSTRACT

A modular fire safe is provided. The modular fire safe includes a base module. The base module has an interior shell and one or more groove assemblies. One or more intermediate modules are positioned in a vertically stacked arrangement with the base module. The one or more intermediate modules have an interior shell, one or more groove assemblies and one or more tongue assemblies. A top module is positioned in a vertically stacked arrangement with an uppermost intermediate module. The top module has an interior shell and one or more tongue assemblies. The tongue assemblies are configured to be received by the groove assemblies such that the base, intermediate and top modules form an assembled modular fire safe. A plurality of retention members extend transversely through the interior shells of the base, intermediate and top modules to secure the tongue assemblies to the groove assemblies.

20 Claims, 7 Drawing Sheets

(56) References Cited

U.S. PATENT DOCUMENTS 591,188 A * 10/1897 Hollar
620,073 A * 2/1899 Holmes
649,455 A * 5/1900 Hough
840,680 A * 1/1907 Arnold
883,489 A * 3/1908 Schossow
D990,810 4/1911 Grashin
1,038,428 A 9/1912 Pederson
1,194,305 A * 8/1916 McMillan ..... E04L 31/3205 52/245
1,195,309 A 8/1916 White
1,218,248 A * 3/1917 Ely ..... E05G 1/00 109/79
1,241,615 A 10/1917 Farrow
1,351,133 A * 8/1920 Scharwath ..... F16L 59/15 138/113
1,441,874 A 1/1923 Mosler et al.
1,467,340 A * 9/1923 Siegel ..... E04L 32/12 446/127
1,525,203 A 2/1925 Schmitz
1,561,845 A * 11/1925 Goldsmith ..... E05G 1/024 109/76
1,921,690 A 8/1933 Miller
1,934,272 A 11/1933 Miller
1,937,931 A 12/1933 Wolters
2,081,316 A * 5/1937 Wilkinson ..... E05B 65/0075 109/73
2,201,948 A 5/1940 Watkins
2,253,564 A 8/1941 Jones
2,270,551 A 1/1942 Peiter
2,309,149 A * 1/1943 Wood ..... E04B 1/18 109/1 S
2,379,157 A 6/1945 Jones
2,390,732 A 12/1945 Page
2,655,882 A * 10/1953 Tripp ..... B65D 81/3823 109/79
2,853,355 A 9/1958 Paca et al.
3,327,882 A * 6/1967 Andrews ..... B65D 90/06 220/4.28
3,408,966 A 11/1968 Gartner
3,559,594 A 2/1971 Miller
3,696,960 A * 10/1972 Smirle ..... B65D 21/08 220/23.4
4,154,493 A * 5/1979 Prater ..... H02B 1/46 312/108
4,249,555 A 2/1981 Scaramucci
4,263,365 A 4/1981 Burgess et al.
4,389,948 A 6/1983 Sands et al.
4,541,545 A 9/1985 Beattie et al.
4,559,881 A * 12/1985 Lankard ..... B28B 23/00 106/644
4,754,715 A * 7/1988 Squires ..... E05B 65/0075 109/59 T
4,793,667 A * 12/1988 Gilliom ..... A47B 47/03 312/108
4,893,397 A 1/1990 Hughes
5,016,946 A * 5/1991 Reznikov ..... A47B 87/02 312/108
5,031,974 A * 7/1991 Feucht ..... A47B 47/025 312/108
5,107,652 A * 4/1992 Sosa ..... E02D 29/025 160/135
5,152,231 A 10/1992 Preston et al.
5,386,788 A * 2/1995 Linker ..... E05G 1/024 109/58
5,486,041 A * 1/1996 Sykes ..... A47B 87/007 312/108
5,797,665 A * 8/1998 Jeter ..... A47B 96/04 108/27
5,813,738 A * 9/1998 Cheng ..... F16B 12/14 312/257.1
5,921,645 A 7/1999 Lapi
6,135,583 A * 10/2000 Simon ..... A47B 47/00 108/189
6,193,340 B1 * 2/2001 Schenker ..... A47B 47/0075 312/108
6,332,657 B1 * 12/2001 Fischer ..... A47B 47/0008 312/111
6,474,759 B2 * 11/2002 Hsu ..... A47B 47/042 312/108
6,736,473 B2 5/2004 Cleveland et al.
6,827,231 B2 * 12/2004 Budowski ..... B60R 11/06 220/4.28
6,834,920 B2 * 12/2004 Landsberger ..... A47B 47/0091 312/108
7,165,822 B2 1/2007 Kiefel et al.
7,748,797 B2 7/2010 Cleveland et al.
7,828,399 B1 11/2010 Bass
7,967,401 B2 * 6/2011 Hsu ..... A47B 47/0008 312/108
8,327,778 B2 12/2012 DelloRusso, Jr.
8,402,610 B2 3/2013 Boes
8,454,104 B2 6/2013 Pallo
8,477,488 B2 7/2013 Aldridge
8,498,113 B2 7/2013 Tran et al.
8,544,968 B2 10/2013 Davidson et al.
8,567,879 B2 * 10/2013 Carter ..... A47F 5/08 248/188.5
8,978,333 B2 * 3/2015 Potter ..... E04B 1/92 52/582.1
2002/0005151 A1 1/2002 Alizade
2002/0043905 A1 * 4/2002 Insalaco ..... A47B 47/00 312/108
2002/0062768 A1 5/2002 Schilz et al.
2002/0089270 A1 * 7/2002 Hughes ..... A47B 47/042 312/263
2002/0166483 A1 11/2002 Alizade
2003/0127956 A1 * 7/2003 Stoever ..... A47B 47/02 312/257.1
2004/0083935 A1 5/2004 Alizade
2006/0181184 A1 8/2006 Klus
2006/0279182 A1 12/2006 Chi Ming
2008/0122327 A1 * 5/2008 Wu ..... A47B 47/025 312/257.1
2008/0246376 A1 * 10/2008 Krieger ..... A47B 47/042 312/257.1
2010/0156257 A1 6/2010 Backaus
2010/0181881 A1 * 7/2010 Hsu ..... A47B 47/0008 312/257.1
2012/0216727 A1 8/2012 Liangguo
2015/0082727 A1 * 3/2015 Laufer ..... E04F 13/0876 52/478
2015/0320207 A1 * 11/2015 Chan ..... A47B 87/0276 312/108

* cited by examiner

TONGUE AND GROOVE MODULAR FIRE SAFE

RELATED APPLICATIONS

This application claims priority from pending U.S. Provisional Patent Application No. 62/136,452, filed Mar. 21, 2015, the disclosure of which is incorporated herein by reference in its entirety.

BACKGROUND

A safe (also called a strongbox or coffer) is a secure, typically lockable box used for protecting valuable objects against theft and/or damage from destructive elements, such as for example, fire. In one form, a safe can be a hollow cuboid, with one face being removable or hinged to form a door.

One specialized form of a safe is a fire-resistant safe (commonly referred to as a fire safe). A fire safe is configured to protect its contents from high temperatures or actual fire. Fire safes are usually rated by the amount of time they can withstand the extreme temperatures a fire produces, while not exceeding a set internal temperature, e.g., less than 350° F. (177° C.) for selected time durations.

Fire safes can be constructed from heavy materials, such as for example, steel and iron forming walls and frames and other heavy materials, such as for example, concrete configured to form intermediate wall structures within protective shell materials. Accordingly, fire-resistant safes can be very heavy, with larger safes weighing in excess of 500 pounds.

The weight and size of a fire-resistant safe can affect the location of a fire safe within a building or residence. For example, a large fire safe is rarely located in areas above a ground floor due to the structural impact of the fire safe on the building or residence and the extensive effort required to position the fire safe in those locations.

It would be advantageous if fire safes could be improved to make them easier to locate within buildings or residences.

SUMMARY

The above objects as well as other objects not specifically enumerated are achieved by a modular fire safe. The modular fire safe includes a base module. The base module has a plurality of base module cavities fromed between an interior shell and an exterior shell, and one or more base module groove assemblies disposed within the plurality of base module cavities. Each of base module groove assemblies configured to form a base module first groove. One or more intermediate modules is positioned in a vertically stacked arrangement with the base module. The one or more intermediate modules has a plrality of intermediate module cavities fromed between an interior shell and an exterior shell, one or more intermediate module groove assemblies disposed within an upper level of the plurality of intermediate module and one or more intermediate module tongue assemblies disposed within a lower level of the plurality of intermediate module cavities, each of the intermediate module groove assiemblies configured to form an intermediate module first groove, each of the intermediate module tongue assemblies having a first extension disposed int eh plurality of intermediate module cavities and a second extension extending from the one or more intermediate modules. A top module is positioned in a vertically stacked arrangement with an uppermost intermediate module. The top module has a plurality of top module cavities formed between an interior shell and an exterior shell and one or more top module tongue assemblies, each of the top module tongue assemblies has a first extension disposed in a pluraltiy of top module cavites and a second extension extending from the one or more tip modules. The second extension of the one or more intermediate module tongue assemblies are disposed in the base module first grooves of the one or more base module groove assemblies and the second extension of the one or more top module tongue assemblies are disposed in the intermediate module first grooves of the one or more intermediate groove assemblies such that the base, intermediate and top modules form an assembled modular fire safe. A plurality of retention members extend through the interior shells of the base, module, one or more intermediate modules to secure the one or more top module and one or more intermediate module tongue assemblies to the one or more intermediate and one or more base module groove assemblies.

There is also provided a method of forming a modular fire safe. The method includes the steps of forming a base module having a plurality of base module cavities formed between an interior shell and an exterior shell, and one or more base module groove assemblies disposed within the plurality of base module cavities, each of the base module groove assemblies configured to form a base module first groove, forming one or more intermediate modules and positioning the one or more intermediate modules in a vertically stacked arrangement with the base module, the one or more intermediate modules having a plurality of intermediate module cavities formed between an interior shell, and an exterior shell,one or more intermediate module groove assemblies disposed within an upper level of the plurality of intermediate module cavities and one or more intermediate module tongue assemblies, disposed within a lower level of the plurality of intermediate modules cavities, each of the intermediate module grrove assemblies configured to form an intermediate module first groove, each of the intermediate module tongue assemblies having a first extension desposed in the plurality of intermediate module cavities and a second extension extension extending from the one or more intermediate modules, forming a top module and positioning the top module in a vertically stacked arrangement with an uppermost intermediate module, the top module having a plurality of top module cavities formed between an interior shell an exterior shell and one or more top module tongue assemblies, each of the top module tongue assemblies having a first extension disposed in the plurality of top module cavities and a second extension extending from the one or more top modules and disposing the second extension of the one or more intermediate modules tongue assemblies of the one or more intermediate modules in the base module first grooves of the one or more base module groove assemblies and the secod extension of the one or more top module tongue assemblies in the intermediate module first groove assemblies such that the base, intermediate and top modules form an assembled modular fire safe and extending a plurality of retention members through the interior shells of the base module and one or more intermediate module tongue assemblies to the one or more base module and one or more intermediate module groove assemblies.

Various objects and advantages of the modular fire safe will become apparent to those skilled in the art from the following detailed description, when read in light of the accompanying drawings.

DETAILED DESCRIPTION

Figure 1:
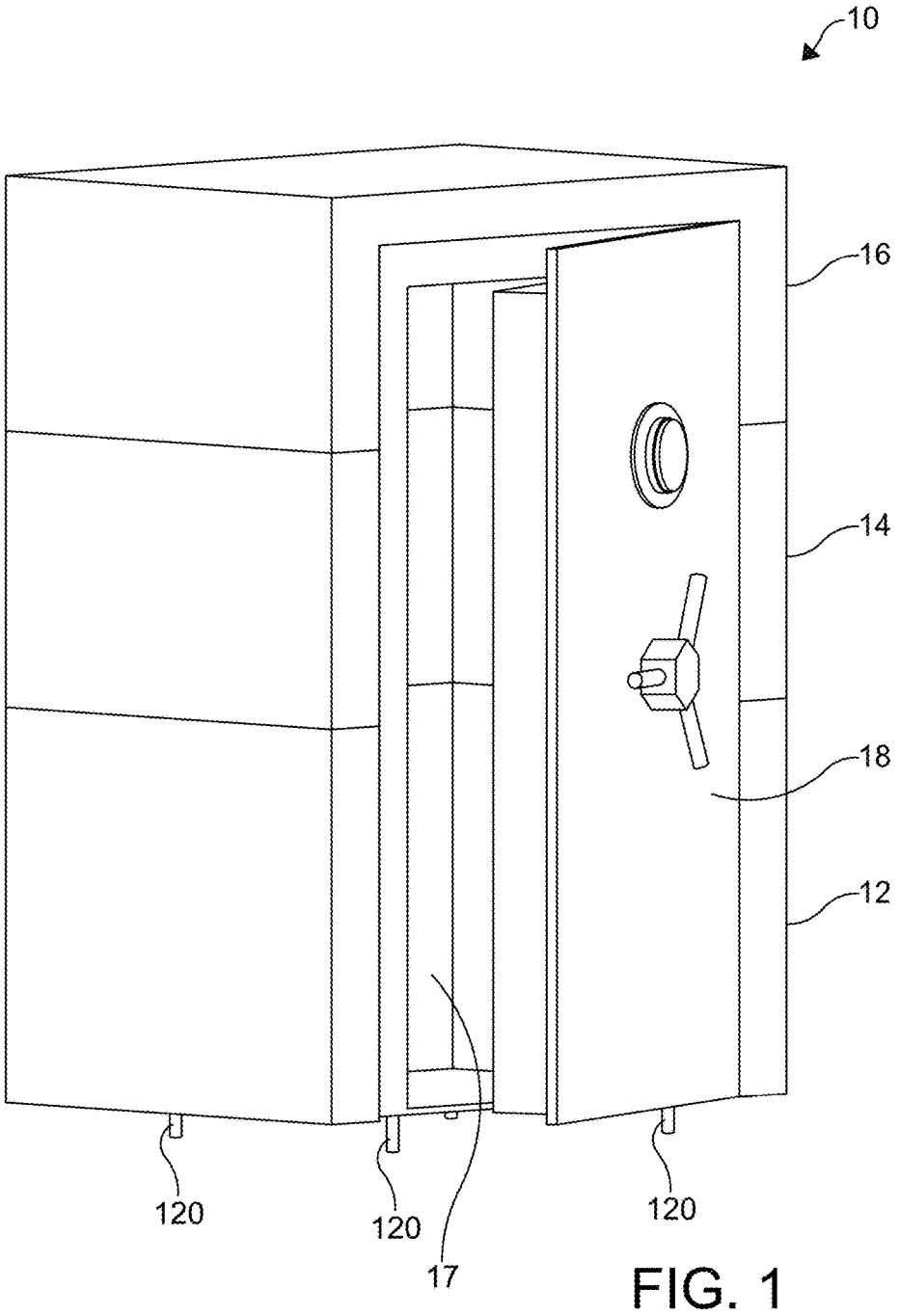
FIG. 1 is a perspective view of a modular fire safe.

A modular fire safe having modules connected to each other with tongue and groove construction will now be described with occasional reference to specific embodiments. The modular fire safe may, however, be embodied in different forms and should not be construed as limited to the embodiments set forth herein. Rather, these embodiments are provided so that this disclosure will be thorough and complete, and will fully convey the scope of the modular fire safe to those skilled in the art.

Unless otherwise defined, all technical and scientific terms used herein have the same meaning as commonly understood by one of ordinary skill in the art to which the modular fire safe belongs. The terminology used in the description of the modular fire safe herein is for describing particular embodiments only and is not intended to be limiting of the modular fire safe. As used in the description of the modular fire safe and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the modular fire safe. Notwithstanding that the numerical ranges and parameters setting forth the broad scope of the modular fire safe are approximations, the numerical values set forth in the specific examples are reported as precisely as possible. Any numerical values, however, inherently contain certain errors necessarily resulting from error found in their respective measurements.

Referring now to the drawings, there is illustrated a modular fire safe having stacked modules connected to each other with tongue and groove construction. In an assembled arrangement, the stacked modules result in a single cohesive and protective unit. In the event it is desired to position the modular fire safe in a certain location, the modular fire safe can be easily disassembled and the individual modules can be readily moved to any desired location for re-assembly, requiring limited equipment and manpower.

The term "safe", as used herein, is defined to mean a structure used for protecting objects located within the safe. The term "fire safe", as used herein, is defined to mean a structure used for protecting valuable objects located within the fire safe against theft and/or damage from destructive elements. The term "destructive elements", as used herein, is defined to mean potentially damaging environmental conditions, including for example, fire or water. The term "modular", as used herein, is defined to mean as being composed of modules.

Figure 2:
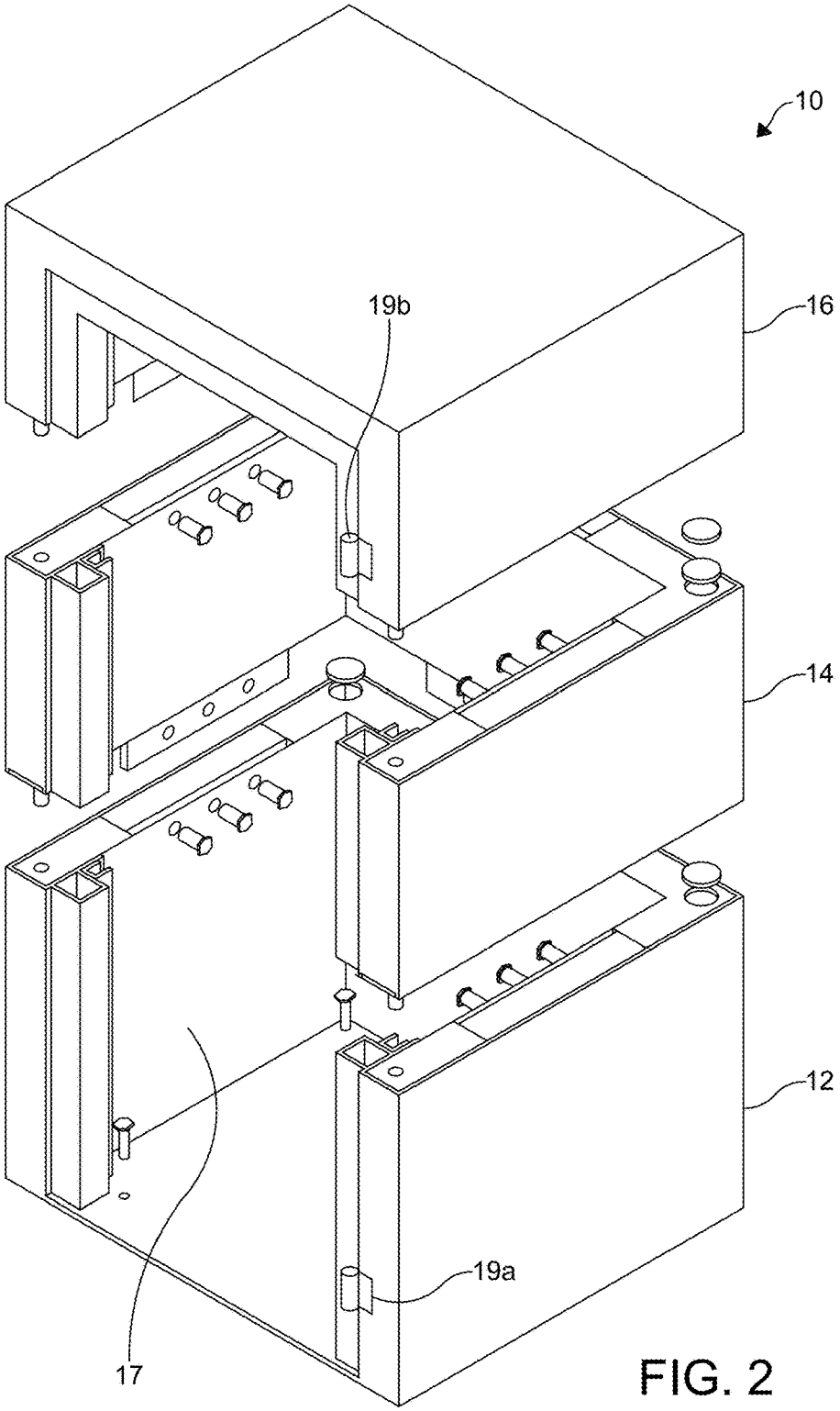
FIG. 2 is an exploded perspective view of the modular fire safe of FIG. 1.

Referring now to FIGS. 1 and 2, a modular fire safe is shown generally at 10. The modular fire safe 10 includes a base module 12, one or more intermediate modules 14, a top module 16 and a door 18. The door 18 forms a front portion of the modular fire safe 10 and portions of the base module 12, one or more intermediate modules 14 and top module opposite the door 18 form rear portions of the modular first safe 10. The base module 12, one or more intermediate modules 14 and the top module 16 are configured for assembly in a vertically stacked arrangement, thereby forming the modular fire safe 10. As will be explained in more detail below, the base, intermediate and top modules 10, 12 and 14 are assembled together using tongue and groove construction structures.

Referring again to FIG. 2, the door (not shown) is supported by a first hinge 19*a* and positioned on the base module 12 and a second hinge 19*b* positioned on the top module 16. Accordingly, the base module 12 and the top module bear the weight of the door. While the hinges 19*a*, 19*b* are illustrated as being positioned on the "right side" of the base and top modules 12, 16, in other embodiments the hinges 19*a*, 19*b* can be positioned on the opposite side of the base and top modules 12, 16, sufficient to bear the weight of the door. The hinges 19*a*, 19*b* can have any desired structure sufficient to bear the weight of the door.

Referring again to FIGS. 1 and 2, in an assembled arrangement, the base, intermediate and top modules 10, 12 and 14 cooperate to form a storage cavity 17 within the modular fire safe 10. The storage cavity 17 is configured for storage of desired items.

Figure 3:
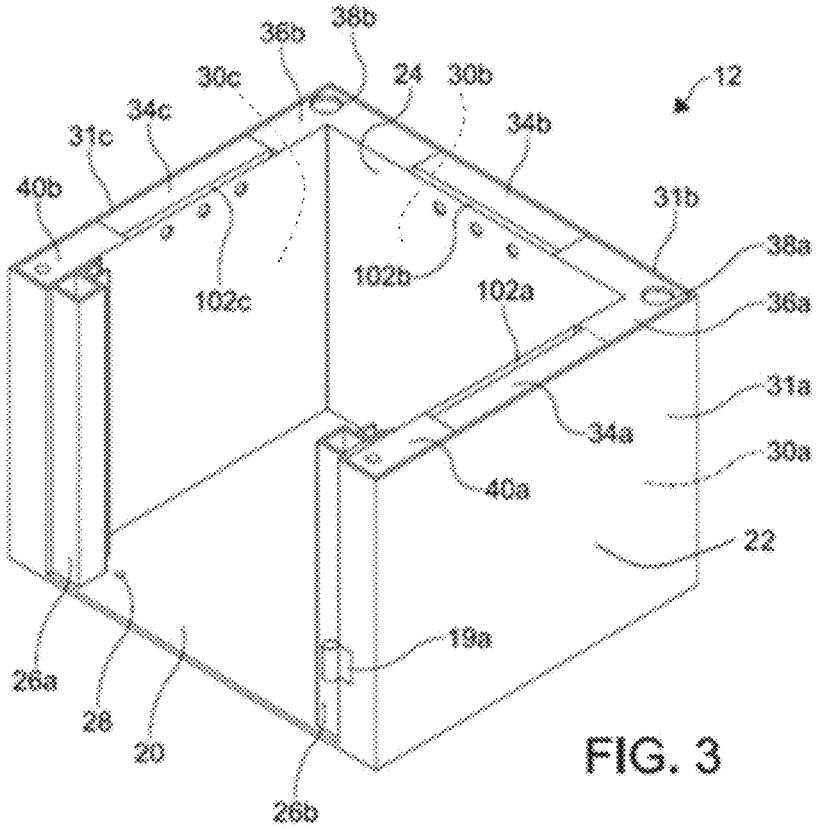
FIG. 3 is a perspective view of a base module of the module fire safe of FIG. 1.

Referring now to FIG. 3, the base module 12 is illustrated. The base module 12 includes a base plate 20, an exterior shell 22, an interior shell 24 and opposing door jambs 26*a*, 26*b*. The base plate 20 is configured to support the weight of the base, intermediate and top modules 10, 12 and 14 and is formed from a metallic material, such as for example, steel or cast iron. In the illustrated embodiment, the base plate 20 has a rectangular shape. However, in other embodiments, the base plate 20 can have other shapes, such as for example a square shape. The base plate 20 includes a plurality of apertures 28 extending there through. The apertures 28 will be discussed in more detail below.

Referring again to FIG. 3, the exterior shell 22 is configured to extend around three sides of a perimeter of the base plate 20 and further configured as a protective layer against unauthorized entry into the modular fire safe 10 and/or damage from destructive elements. In the illustrated embodiment, the exterior shell 22 is formed from a protective material, such as for example, heavy gauge sheet steel or other metallic materials. In alternate embodiments, the exterior shell 22 can be formed from other desired materials including one or more structural plates. The exterior shell 22 can include various functional and decorative finishes including the non-limiting examples of rust preventative, anti-microbial and anti-fungal coatings. In the illustrated embodiment, the exterior shell 22 is connected to the base plate 20 by welding, however, other desired methods can be used, including but not limited to threaded fasteners.

Referring again to FIG. 3, the interior shell 24 is spaced apart from and nested within the exterior shell 22 and extends around the same three sides of the base plate 20 as the exterior shell 22. The interior shell 24 is also configured as a protective layer against unauthorized entry and/or damage from destructive elements. In certain embodiments, the interior shell 24 is formed from the same materials as that used for the exterior shell 22. Alternately, the interior shell 24 can be formed from materials other than those used for the exterior shell 22. In the illustrated embodiment, the interior shell 24 is connected to the base plate 20 by welding, however, other desired methods of attachment may be used.

Referring again to FIG. 3, a first cavity 30*a* is defined by the exterior shell 22, the interior shell 24 and the base plate 20 in a first wall module 31*a*, a second cavity 30*b* is defined by the exterior shell 22, the interior shell 24 and the base plate 20 in a second wall module 31*b* and a third cavity 30*c* is defined by the exterior shell 22, the interior shell 24 and the base plate 20 in a third wall module 31*c*. The cavities 30*a*-30*c* are filled with insulative and/or fire resistant materials, such as for example concrete, sheet rock or ceramic batting. The insulative and/or fire resistant materials are configured to substantially insulate the contents of the storage cavity 17 from damage due to destructive elements, such as for example, fire and the like. In certain embodiments, the exterior shell 22, interior shell 24 and the materials positioned within the cavities 30*a*-30*c* can be configured to produce a desired fire rating for a desired temperature and duration.

Referring again to FIG. 3, base module door jambs 26*a*, 26*b* are substantially vertical frames and configured to receive one or more locking bolts (not shown) extending from the door 18. In the illustrated embodiment, the base module door jambs 26*a*, 26*b* are formed from metallic square tubes or channels. However, in other embodiments, the base module door jambs 26*a*, 26*b* can have other forms and can be formed from other materials sufficient to receive one or more locking bolts (not shown) extending from the door 18.

Referring again to FIG. 3, the base module 12 includes a first groove assembly 34*a* positioned at an upper level of the first cavity 30*a*, a second groove assembly 34*b* positioned at an upper level of the second cavity 30*b* and a third groove assembly 34*c* positioned at an upper level of the third cavity 30*c*. The groove assemblies 34*a*-34*c* will be discussed in more detail below.

Referring again to FIG. 3, a first rear corner cap 36*a* is positioned at an intersection of an upper level of the first and second cavities 30*a*, 30*b* and a second rear corner cap 36*b* is positioned at an intersection of an upper level of the second and third cavities 30*b*, 30*c*.

Figure 11:
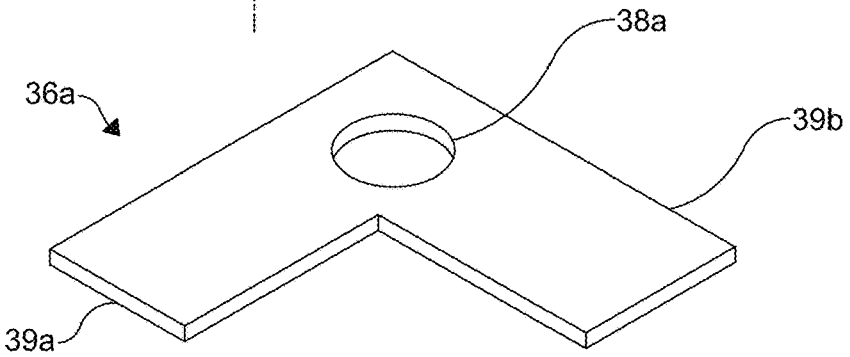
FIG. 11 is a perspective view of a rear corner cap of the intermediate module of FIG. 4.

A representative rear corner cap 36*a* is shown in FIG. 11. The rear corner cap 36*a* includes an aperture 38*a* positioned between extension segments 39*a*, 39*b*. Extension segment 39*a* extends at the upper level of the first cavity 30*a* and extension segment 39*b* extends at the upper level of the second cavity 30*b*. The aperture 38*a* is configured as an entry point for injection of viscous insulation materials, such as for example concrete, into the cavities 30*a*-30*c* of the base module 12. In the illustrated embodiment, the aperture 38*a* has a circular cross-sectional shape. In other embodiments, the aperture 38*a* can have any desired cross-sectional shape, sufficient to be an entry point for injection of the viscous insulative material into the cavities 30*a*-30*a* of the base module 12. Optionally, the aperture 38*a* can be covered with a covering structure (not shown).

Figure 10:
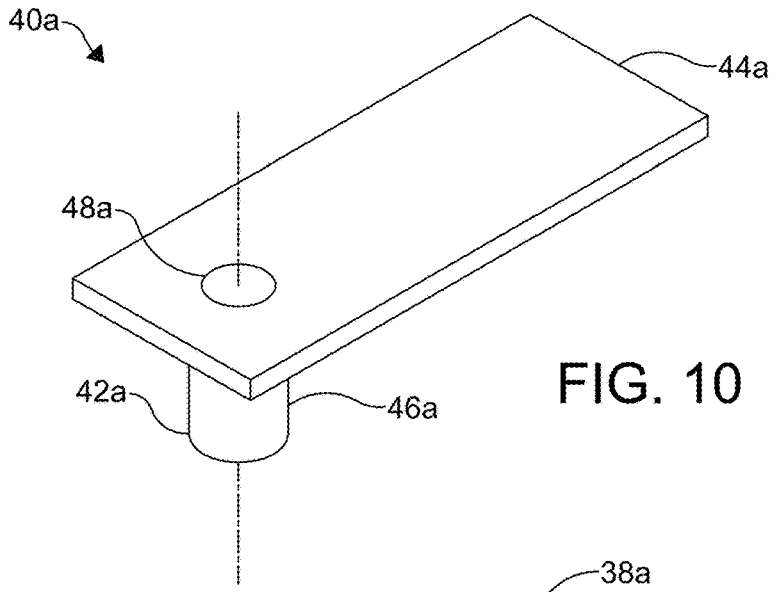
FIG. 10 is a perspective view of a front corner cap of the intermediate module of FIG. 4.

Referring again to FIG. 3, a first front corner cap 40*a* is positioned at an upper level of the first cavity 30*a* and a second front corner cap 40*b* is positioned at an upper level of the third cavity 30*c*. A representative front corner cap 40*a* is shown in FIG. 10. The front corner cap 40*a* includes a receptive structure 42*a* positioned at one end of an extension segment 44*a*. Extension segment 44*a* extends at the upper level of the first cavity 30*a*. The receptive structure 42*a* includes a hollow, walled element 46*a* aligned with an aperture 48*a*. The receptive structure 42*a* will be discussed in more detail below.

Figure 4:
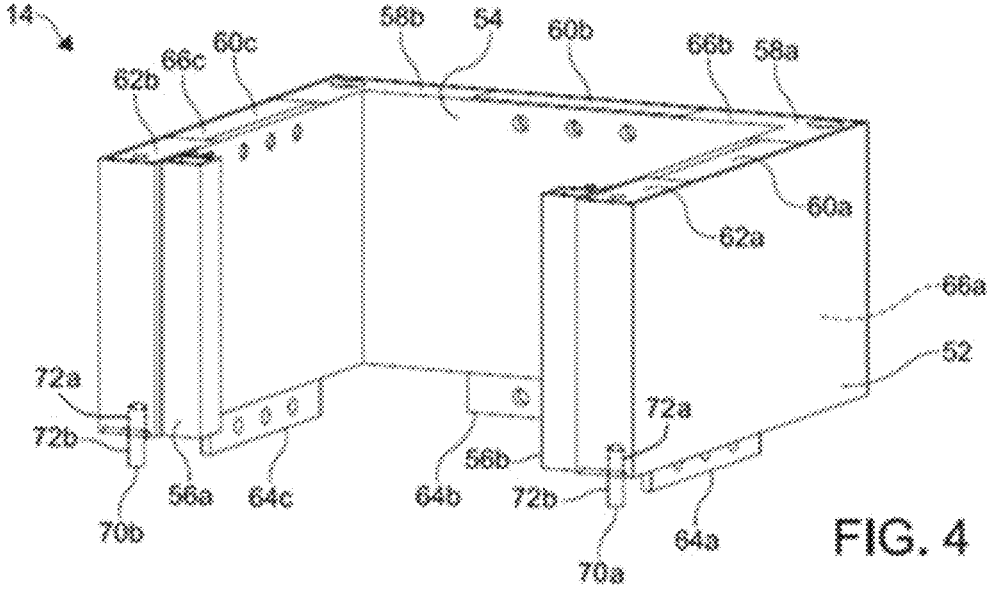
FIG. 4 is a perspective view of an intermediate module of the module fire safe of FIG. 1.

Referring now to FIG. 4, an intermediate module 14 is illustrated. The intermediate module 14 includes an exterior shell 52, an interior shell 54, opposing door jambs 56*a*, 56*b*, rear corner caps 58*a*, 58*b*, groove assemblies 60*a*-60*c* and front corner caps 62*a*, 62*b*. In the illustrated embodiment, the exterior shell 52, interior shell 54, opposing door jambs 56*a*, 56*b*, rear corner caps 58*a*, 58*b*, groove assemblies 60*a*-60*c* and front corner caps 62*a*, 62*b* are the same as, or similar to, the exterior shell 22, interior shell 24 and opposing door jambs 26*a*, 26*b*, rear corner caps 36*a*, 36*b*, groove assemblies 34*a*-34*c* and front corner caps 40*a*, 40*b* illustrated in FIG. 3 and described above. However, it should be appreciated that in other embodiments, the exterior shell 52, interior shell 54 and opposing door jambs 56*a*, 56*b*, rear corner caps 58*a*, 58*b*, groove assemblies 60*a*-60*c* and front corner caps 62*a*, 62*b* can be different from the exterior shell 22, interior shell 24 and opposing door jambs 26*a*, 26*b*, rear corner caps 36*a*, 36*b*, groove assemblies 34*a*-34*c* and front corner caps 40*a*, 40*b*.

Referring again to FIG. 4, the intermediate module 14 includes a first tongue assembly 64*a* positioned at a lower level of a first cavity 66*a*, a second tongue assembly 64*b* positioned at a lower level of a second cavity 66*b* and a third tongue assembly 64*c* positioned at a lower level of a third cavity 66*c*. The tongue assemblies 64*a*-64*c* will be discussed in more detail below.

Figure 9:
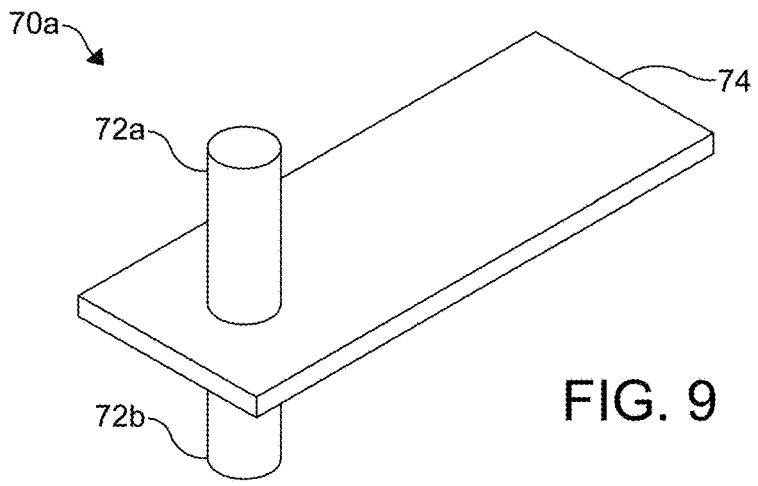
FIG. 9 is a perspective view of a front pin assembly of the intermediate module of FIG. 4.

Referring again to FIG. 4, a first front pin assembly 70*a* is positioned at a lower level of the first cavity 66*a* and a second front pin assembly 70*b* is positioned at a lower level of the third cavity 66*c*. A representative front pin assembly 70*a* is shown in FIG. 9. The front pin assembly 70*a* includes an upper pin structure 72*a* extending in a first direction from one end of an extension segment 74 and an axially aligned lower pin structure 72*b* extending in an opposite direction from the extension segment 74. In an installed position in the intermediate module 14, the upper pin structure 72*a* is positioned within the first cavity 66*a* and the lower pin structure 72*b* is exposed. The front pin assemblies 70*a*, 70*b* will be discussed in more detail below.

Figure 5:
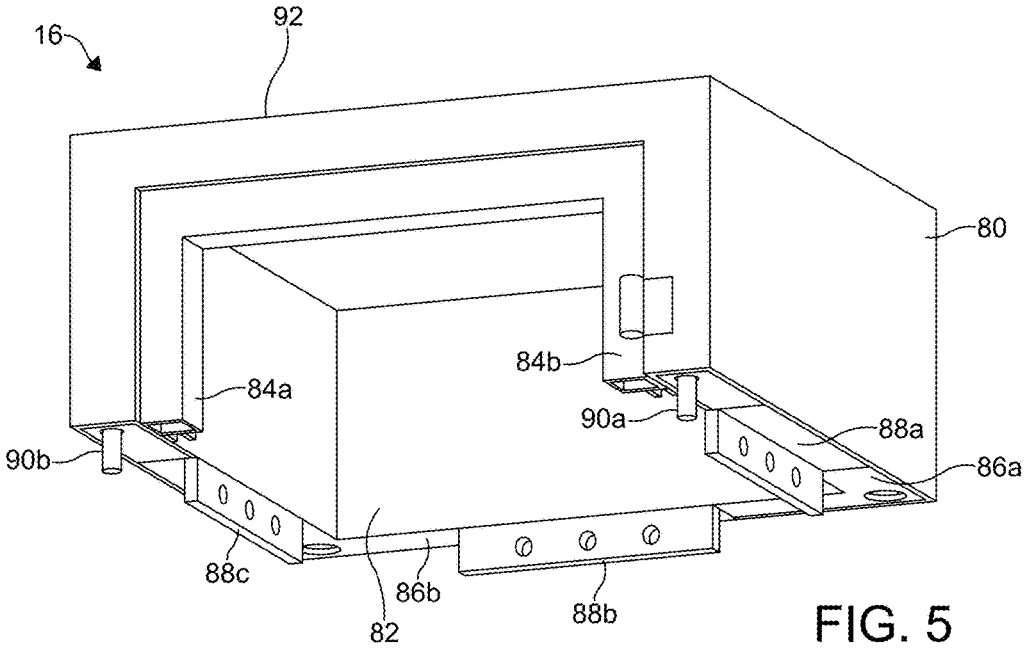
FIG. 5 is a perspective view of a top module of the module fire safe of FIG. 1.

Referring now to FIG. 5, the top module 16 is illustrated. The top module 16 includes an exterior shell 80 extending around three sides of a perimeter of a top 92, an interior shell 82 spaced apart from and nested within the exterior shell 80 and extending around the same three sides of the top 92, opposing door jambs 84*a*, 84*b*, rear corner caps 86*a*, 86*b*, tongue assemblies 88*a*-88*c* and front pin assemblies 90*a*, 90*b*. In the illustrated embodiment, the exterior shell 80, interior shell 82, opposing door jambs 84*a*, 84*b*, rear corner caps 86*a*, 86*b*, tongue assemblies 88*a*-88*c*, front pin assemblies 90*a*, 90*b* are the same as, or similar to, the exterior shell 52, interior shell 54 and opposing door jambs 56*a*, 56*b*, rear corner caps 58*a*, 58*b*, tongue assemblies 64*a*-64*c* and front pin assemblies 70*a*, 70*b* illustrated in FIG. 4 and described above. However, it should be appreciated that in other embodiments, the exterior shell 80, interior shell 82, opposing door jambs 84*a*, 84*b*, rear corner caps 86*a*, 86*b*, tongue assemblies 88*a*-88*c* and front pin assemblies 90*a*, 90*b* can be different from the exterior shell 52, interior shell 54 and opposing door jambs 56*a*, 56*b*, rear corner caps 58*a*, 58*b*, tongue assemblies 64*a*-64*c* and front pin assemblies 70*a*, 70*b*.

Referring again to FIG. 5, the top 92 is configured as a protective layer against unauthorized entry into the modular fire safe 10 and/or damage from destructive elements. In the illustrated embodiment, the top 92 is formed from a protective material, such as for example, heavy gauge sheet steel. In alternate embodiments, the top 92 can be formed from other desired materials including one or more structural plates or a filled cavity.

Figure 6:
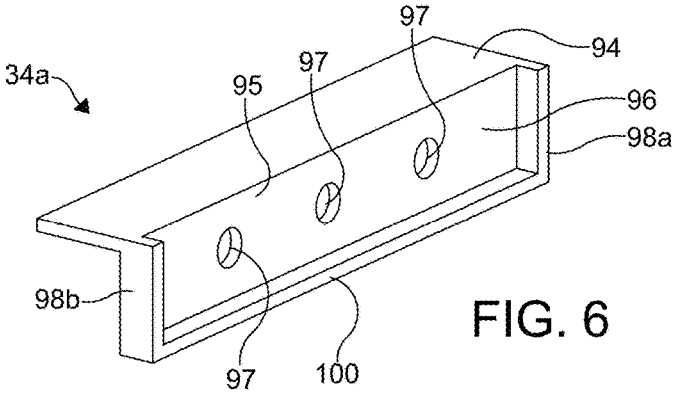
FIG. 6 is a perspective view of a groove assembly of the module fire safe of FIG. 1.

Referring now to FIG. 6, a representative groove assembly is illustrated at 34*a*. The groove assembly 34*a* includes a first element 94 and a second element 96 connected to the first element 94 in a perpendicular arrangement. The second element 96 includes a plurality of apertures 97. In the illustrated embodiment, the apertures 97 are threaded such as to receive a threaded fastener. However, in other the apertures 97 need not be threaded. Opposing side elements 98*a*, 98*b* are connected to the first and second elements 94, 96. A bottom element 100 is connected to the second element 96 and the opposing side elements 98*a*, 98*b*. In the illustrated embodiment, the first element 94, second element 96 and the bottom element 100 of the groove assembly 34*a* are formed from a single piece of material formed to shape. However, in other embodiments, the first element 94, second element 96 and the bottom element 100 of the groove assembly 34*a* can be discrete elements subsequently attached together.

Referring again to FIGS. 3 and 8, the groove assembly 34*a* is shown in an installed position. In the installed position, a first groove 102*a* is defined by the interior shell 24, the components of the groove assembly 34*a* including the second element 96, the side elements 98*a*, 98*b* and the bottom element 100. As will be explained in more detail below, the first groove 102*a* is configured to receive a portion of the tongue assembly 64*a*. A second groove 102*b* is formed in the second wall section 31*b* in the same manner as the first groove 102*a* and a third groove 102*c* is formed in the third wall section 31*c* also in the same manner as the first groove 102*a*. The second groove 102*b* is configured to receive a portion of the tongue assembly 64*b* and the third groove 102*c* is configured to receive a portion of the tongue assembly 64*c*.

Figure 7:
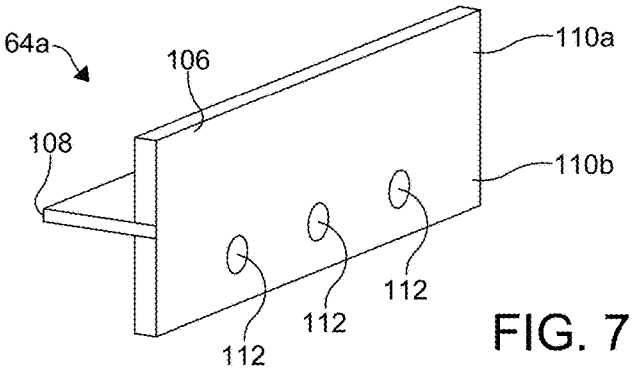
FIG. 7 is a perspective view of a tongue assembly of the module fire safe of FIG. 1.

Referring now to FIG. 7 a representative tongue assembly 64*a* is illustrated. The tongue assembly 64*a* includes a first tongue member 106 and a second tongue member 108 connected together in a perpendicular arrangement. The first tongue member 106 includes a first extension 110*a* and an opposing second extension 110*b*. The second extension 110*b* includes a plurality of apertures 112.

Referring again to FIG. 4, in an installed position in the intermediate module 14, the first extension 110*a* is positioned within the first cavity 66*a* and the second extension 110*b* is exposed.

Figure 8:
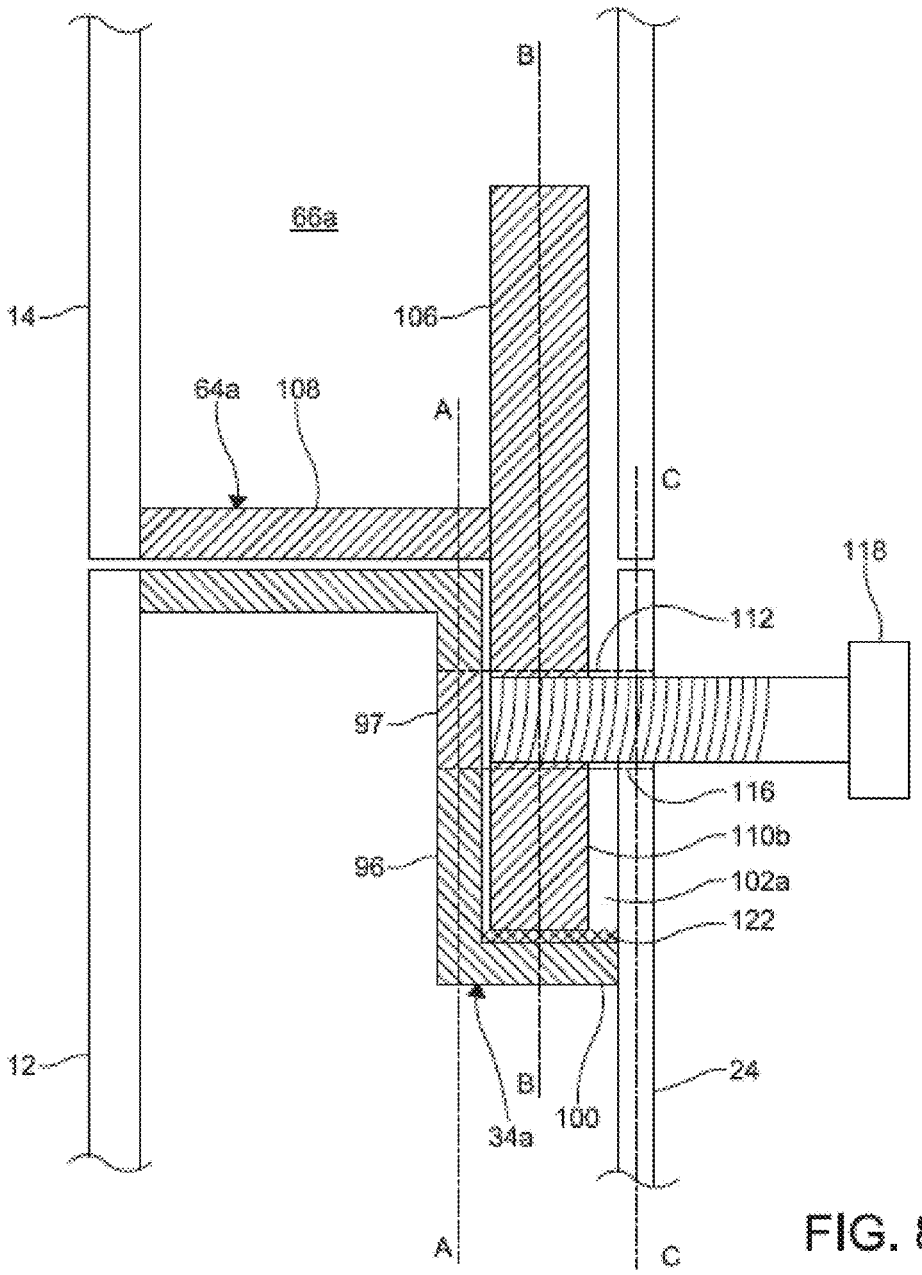
FIG. 8 is a side view, in elevation, of a tongue assembly of the module fire safe of FIG. 1 disposed within a groove assembly of FIG. 6.

Referring again to FIGS. 3 and 7, the second extension 110*b* has a length, width and thickness such as to be received within the grooves 102*a*-102*c*. When assembled in this manner, the groove assembly 34*a* and the tongue assembly 64*a* form a tongue and groove connection. Referring now to FIG. 8, a representative tongue and groove connection between the groove assembly 34*a* and the tongue assembly 64*a* is illustrated. The base module 12 and an intermediate module 14 are shown in a stacked arrangement. The base module 12 includes the groove assembly 34*a* positioned at an upper level of the first cavity 30*a*. The intermediate module 14 includes the tongue assembly 64*a* positioned in a lower level of the first cavity 66*a*. The tongue assembly 64*a* is disposed within the groove assembly 34*a* as the first groove 102*a*, defined by the second element 96, interior shell 24 and bottom element 100 receives the second extension 110*b* of the first groove member 106. In this position, the second element 96 of the groove assembly 34*a*, second extension 110*b* of the tongue assembly 64*a* and the interior shell 24 have major axis A-A, B-B, and C-C respectively, that are substantially vertical and parallel to each other. Also in this position, the second extension 110*b* of the first groove member 106 is positioned adjacent the bottom element 100 and the second tongue member 108 is positioned adjacent the first element 94 of the groove assembly 64*a*. Also in this position, the apertures 97 in the second element 96 align with the apertures 112 in the second extension 110*b* and further align with apertures 116 located in the interior shell 24.

Referring again to FIG. 8, a plurality of retention members 118 extend through the apertures 116 in the interior shell 24, 112 in the second extension 110*b* and engage the apertures 97 in the second element 96 of the groove assembly 34*a*. In the illustrated embodiment, the retention member 118 is a threaded bolt. However, in other embodiments, the retention member can have other forms. The retention member 118 is tightened until the interior shell 24, groove assembly 34*a* and the tongue assembly 64*a* are securely fastened together. As shown in the embodiment illustrated in FIG. 8, the retention member 118 is transversely oriented to the interior shell 24, the second element 96 of the groove assembly 34*a* and to the second extension 110*b* of the tongue assembly 64*a*. However, as will be explained in more detail below, the tongue and groove assemblies can be secured to each other in other manners.

Referring again to FIG. 2, assembly of the modular fire safe 10 will now be described. In an initial step, the bottom, intermediate and top modules 12, 14 and 16 are formed as discussed above. In a next step, an intermediate module 14 is positioned above the bottom module 12 with the tongue assemblies 64*a*-64*c* of the intermediate module 14 aligned with the groove assemblies 34*a*-34*c* of the bottom module 12 and the lower pin structures 72*a*, 72*b* of the front pin assemblies 70*a*, 70*b* aligned with the apertures 48*a* in the front corner caps 40*a*, 40*b*. The intermediate module 14 is lowered such that the tongue assemblies 64*a*-64*c* of the intermediate module 14 are received by the groove assemblies 34*a*-34*c* of the bottom module 12 and the lower pin structures 72*a*, 72*b* of the front pin assemblies 70*a*, 70*b* are received by the receptive structures 42*a* in the front corner caps 40*a*, 40*b*. Next, the retention members 118 are used to secure the tongue assemblies 64*a*-64*c* to the groove assemblies 34*a*-34*c*. Additional intermediate modules can be stacked on top of existing intermediate modules as desired. The top module 16 is added to the stacked assembly and secured to the upper most intermediate module in the same manner. Next, the door 18 is lowered onto the hinges 19*a*, 19*b* located on the base and top modules 12, 16, thereby allowing the door 18 to close against the door jambs 26*a*, 26*b*, 56*a*, 56*b*, 84*a* and 84*b*.

Referring again to FIGS. 4 and 5, the front pin assemblies 70*a*, 70*b*, 90*a*, 90*b* having the lower pin structures are configured for several functions. First, the front pin assemblies 70*a*, 70*b*, 90*a* and 90*b* are configured as alignment mechanisms when assembling the modules 12, 14 and 16 forming the modular fire safe 10. In this mode, the front pin assemblies 70*a*-70*b*, 90*a* and 90*b* align with the receptive structures 42*a* in the front corner caps 40*a*, 40*b*, 62*a*, 62*b*, thereby ensuring alignment of the exterior shells of the base module 12 with the exterior shells 52, 80 of the intermediate and top modules 14, 16. Next, for an assembled modular fire safe 10, the front pin assemblies 70*a*, 70*b*, 90*a* and 90*b* are configured to provide an additional security measure to resist separation of the door 18 from the modules 12, 14 and 16 or separation of the modules 12, 14 and 16 from each other. In one non-limiting example, the front pin assemblies 70*a*, 70*b*, 90*a* and 90*b* are configured to resist a leveraging force (e.g. crow bar) positioned between the door 18 and a module 12, 14 or 16. Since the upper and lower pin structures 72*a*, 72*b* extend into the adjacent wall sections of adjacent modules 12, 14 or 16, the front pin assemblies 70*a*, 70*b*, 90*a* and 90*b* provide significant resistance against separation of the door 18 from the modules 12, 14 or 16 or separation of the modules 12, 14 and 16 from each other due to the leveraging force.

Advantageously, the modular nature of the modular fire safe 10 allows for easy placement at a desired location by dividing the total weight of the modular fire safe 10 into two or more modules that can be moved more easily, prior to assembly, into a desired location. Also, by adding additional modules and replacing the door with a larger door, the modular fire safe can easily be made larger to accommodate additional valuables.

Referring again to FIGS. 1 and 3, optionally anchor elements 120 can extend through the apertures 28 in the base plate 20. The anchor elements 120 are configured to anchor the modular fire safe 10 to a floor (not shown). In the illustrated embodiment, the anchor elements are threaded fasteners. Alternatively, any desired fastener or structure can be used sufficient to anchor the modular fire safe 10 to a floor.

Referring again to FIG. 8, optionally fire resistant materials 122 can be positioned between the second extension member 110*b* and the bottom element 100 and also in the seams between the modules 12, 14 and 16. The fire resistant materials 122 are configured to substantially insulate the contents of the storage cavity 17 from damage due to destructive elements, such as for example, fire and the like. In the illustrated embodiment, the fire resistant materials 122 are formed from mineral fibers. However, in other embodiments, the fire resistant materials 122 can be formed from other materials.

Figure 12:
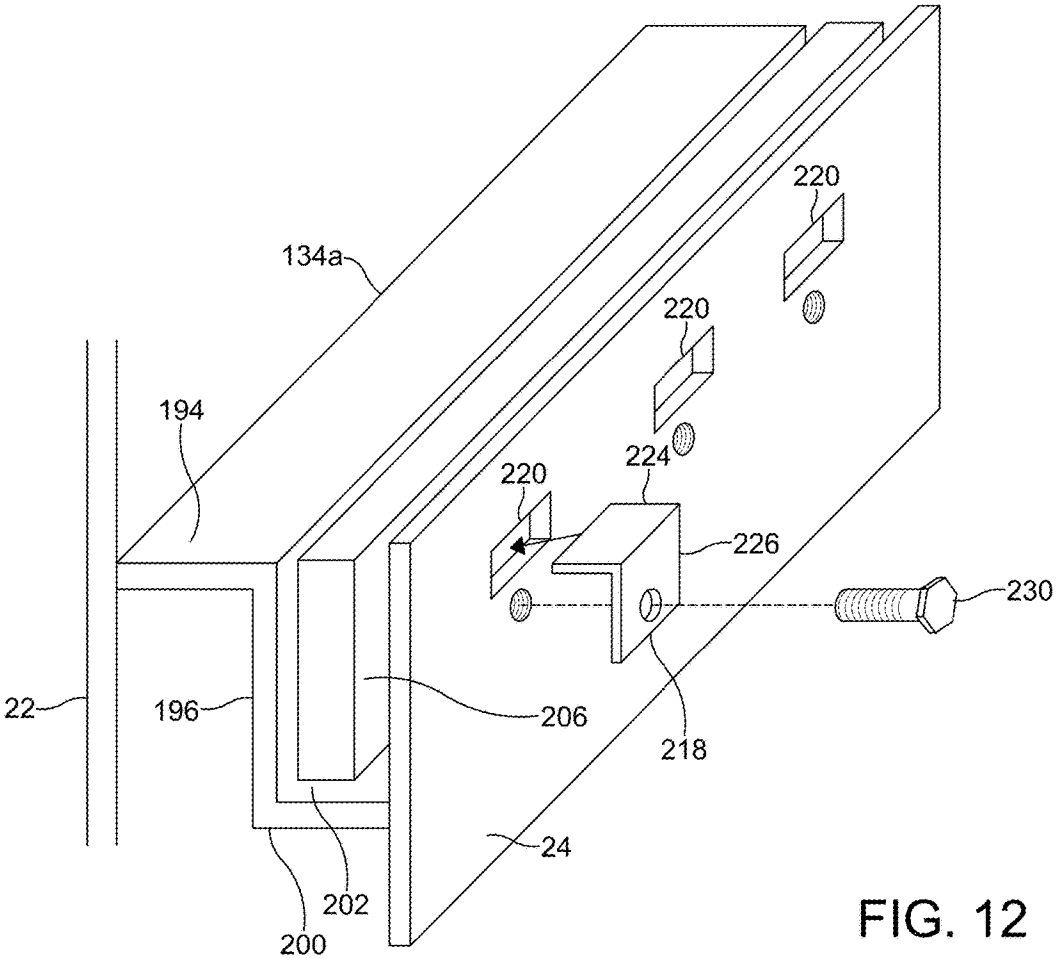
FIG. 12 is a perspective view of a second embodiment of a structure for securing a tongue and groove assembly of the module fire safe of FIG. 1.

Referring again to FIG. 8 and as discussed above, the retention member 118 secures the tongue and groove assemblies to each other and to the interior shell 24. Referring now to FIG. 12, another structure for securing the tongue and groove assemblies to each other and to the interior shell is illustrated. In this embodiment, the exterior shell 22 and the interior shell 24 are the same as the exterior shell 22 and the interior shell 24 shown in FIG. 8 and described above with the exception that the interior shell 24 includes a plurality of slots 220. The slots 220 will be discussed in more detail below.

A groove assembly 134*a* includes a first element 194, a second element 196 and a bottom element 200. The second element 196 includes a plurality of slots (not shown). A groove 202 is defined by the first element 194, a second element 196, bottom element 200 and interior shell 24. The groove 202 receives a first groove member 206 in the same manner as discussed above. The first groove member 206 also includes a plurality of slots (not shown) configured to align with the slots in the second element 196 with the first groove member 206 in a seated position and further configured to align with the slots 220 in the interior shell 24.

Referring again to FIG. 12, a retention member 218 includes a first extension 224 and a second extension 226. The first extension 224 is configured to extend through the slots 220 in the interior shell 24, through the slots in the first groove member 206 and into the slots in the second element 196. A fastener 230 is used to secure the retention member 218 to apertures in the interior shell 24. In this position, the retention member 218 secures the interior shell 24, groove assembly 34*a* and the tongue assembly 64*a* together. As shown in the embodiment illustrated in FIG. 8, the retention member 218 is transversely oriented to the interior shell 24, the second element 196 of the groove assembly 134*a* and to the first groove member 206.

While the modular fire safe has been illustrated and described above with reference to a fire safe, it is within the contemplation of the modular fire safe that certain modules can be used in conjunction with other devices and structures. As one non-limiting example, it is contemplated that a base module could be used as a base and secured to an automatic teller machine (commonly known as an "ATM") in the same manner as described above.

The principle and mode of operation of the tongue and groove modular fire safe have been explained and illustrated in certain embodiments. However, it must be understood that the tongue and groove modular fire safe may be practiced otherwise than as specifically illustrated and described without departing from its spirit or scope.

What is claimed is:

1. A modular fire safe comprising:

a base module having a plurality of base module cavities formed between an interior shell and an exterior shell, and one or more base module groove assemblies disposed within the plurality of base module cavities, each of the base module groove assemblies configured to form a base module first groove;

one or more intermediate modules positioned in a vertically stacked arrangement with the base module, the one or more intermediate modules having a plurality of intermediate module cavities formed between an interior shell and an exterior shell, one or more intermediate module groove assemblies disposed within an upper level of the plurality of intermediate module cavities and one or more intermediate module tongue assemblies disposed within a lower level of the plurality of intermediate module cavities, each of the intermediate module groove assemblies configured to form an intermediate module first groove, each of the intermediate module tongue assemblies having a first extension disposed in the plurality of intermediate module cavities and a second extension extending from the one or more intermediate modules; and a top module positioned in a vertically stacked arrangement with an uppermost intermediate module, the top module having a plurality of top module cavities formed between an interior shell and an exterior shell and one or more top module tongue assemblies, each of the top module tongue assemblies having a first extension disposed in the plurality of top module cavities and a second extension extending from the top module;

wherein the second extension of the one or more intermediate module tongue assemblies are disposed in the base module first grooves of the one or more base module groove assemblies and the second extension of the one or more top module tongue assemblies are disposed in the intermediate module first grooves of the one or more intermediate module groove assemblies such that the base, intermediate and top modules form an assembled modular fire safe; and wherein a plurality of retention members extend through the interior shells of the base module and one or more intermediate modules to secure the one or more top module and one or more intermediate module tongue assemblies to the one or more intermediate and one or more base module groove assemblies.

2. The modular fire safe of claim 1, wherein the one or more base module groove assemblies and the one or more intermediate module groove assemblies each have first elements and second elements, with the first elements connected to the second elements in perpendicular arrangements.

3. The modular fire safe of claim 2, wherein the second elements have a plurality of apertures.

4. The modular fire safe of claim 1, wherein the one or more top module and the one or more intermediate module tongue assemblies each have first tongue members and second tongue members connected together in perpendicular arrangements.

5. The modular fire safe of claim 2, wherein the second elements of the one or more base module and one or more intermediate module groove assemblies have substantially vertical orientations when disposed with the one or more top module and one or more intermediate module tongue assemblies.

6. The modular fire safe of claim 4, wherein the first tongue members of the one or more top module and one or more intermediate module tongue assemblies have substantially vertical orientations when disposed in the one or more base module and one or more intermediate module groove assemblies.

7. The modular fire safe of claim 1, wherein in a disposed arrangement, major axes of second elements of the one or more base module and one or more intermediate module groove assemblies, first extensions of the top module and one or more intermediate module tongue assemblies and interior shells have parallel orientations.

8. The modular fire safe of claim 1, wherein the retention members are threaded members configured to engage threaded apertures in second elements of the one or more base module and one or more intermediate module groove assemblies.

9. The modular fire safe of claim 1, wherein upper front pin structures extend into adjacent wall sections of the adjacent, intermediate and top modules and lower front pin structures extend into adjacent wall sections of the adjacent base and intermediate modules and wherein the upper and lower front pin structures are configured to substantially resist a leveraging force between a door and the base, intermediate and top modules.

10. The module fire safe of claim 9, wherein the lower front pin structures are configured to mate with receptive structures attached to front corner caps.

11. A method of forming a modular fire safe, the method comprising the steps of:

forming a base module having a plurality of base module cavities formed between an interior shell and an exterior shell, and one or more base module groove assemblies disposed within the plurality of base module cavities, each of the base module groove assemblies configured to form a base module first groove;

forming one or more intermediate modules and positioning the one or more intermediate modules in a vertically stacked arrangement with the base module, the one or more intermediate modules having a plurality of intermediate module cavities formed between an interior shell and an exterior shell, one or more intermediate module groove assemblies disposed within an upper level of the plurality of intermediate module cavities and one or more intermediate module tongue assemblies disposed within a lower level of the plurality of intermediate module cavities, each of the intermediate module groove assemblies configured to form an intermediate module first groove, each of the intermediate module tongue assemblies having a first extension disposed in the plurality of intermediate module cavities and a second extension extending from the one or more intermediate modules;

forming a top module and positioning the top module in a vertically stacked arrangement with an uppermost intermediate module, the top module having a plurality of top module cavities formed between an interior shell and an exterior shell and one or more top module tongue assemblies, each of the top module tongue assemblies having a first extension disposed in the plurality of top module cavities and a second extension extending from the one or more top modules;

disposing the second extension of the one or more intermediate module tongue assemblies of the one or more intermediate modules in the base module first grooves of the one or more base module groove assemblies and the second extension of the one or more top module tongue assemblies in the intermediate module groove assemblies such that the base, intermediate and top modules form an assembled modular fire safe; and extending a plurality of retention members through the interior shells of the base module and the one or more intermediate modules to secure the one or more top module and one or more intermediate module tongue assemblies to the one or more base module and one or more intermediate module groove assemblies.

12. The method of claim 11, wherein the one or more base module and one or more intermediate module groove assemblies have first elements and second elements, with the first elements connected to the second elements in perpendicular arrangements.

13. The method of claim 11, wherein the one or more top module and one or more intermediate module tongue assemblies each have first tongue members and second tongue members connected together in perpendicular arrangements.

14. The method of claim 12, wherein the second elements of the one or more base module and one or more intermediate module groove assemblies have substantially vertical orientations when receiving the tongue assemblies.

15. The method of claim 13, wherein the first tongue members of the one or more top module and one or more intermediate module tongue assemblies have substantially vertical orientations when disposed in the one or more base module and one or more intermediate module groove assemblies.

16. The method of claim 11, wherein in a disposed arrangement, major axes of second elements of the one or more base module and one or more intermediate module groove assemblies, first tongue extensions of the top module and one or more intermediate module tongue assemblies and interior shells have parallel orientations.

17. The method of claim 12, wherein the retention members are threaded members configured to engage threaded apertures in the second elements of the one or more base module and one or more intermediate module groove assemblies.

18. The method of claim 11, wherein upper front pin structures extend into adjacent wall sections of the adjacent intermediate and top modules and lower front pin structures extend into adjacent wall sections of the adjacent base and intermediate modules and wherein the upper and lower front pin structures are configured to substantially resist a leveraging force between a door and the base, intermediate and top modules.

19. The method of claim 18, wherein the lower front pin structures are configured to mate with receptive structures attached to front corner caps.

20. The method of claim 19, wherein the front corner caps are positioned at upper levels of the base and intermediate modules.

* * * * *